US005267852A

United States Patent [19]

Mizuno

[11] Patent Number: 5,267,852

[45] Date of Patent: Dec. 7, 1993

[54] GAS CYLINDER

[75] Inventor: Tsutomu Mizuno, Tokyo, Japan

[73] Assignee: Iwatani Sangyo Kabushiki Kaisha, Osaka, Japan

[21] Appl. No.: 920,636

[22] Filed: Jul. 28, 1992

[51] Int. Cl.[5] ..... F23D 14/00; F23D 14/66

[52] U.S. Cl. ..... 431/203; 431/344; 222/2; 126/44; 62/48.4; 62/48.1

[58] Field of Search ..... 62/48.1, 48.4, 46.3, 62/45.1; 431/344, 206, 203; 220/457, 460, 562; 222/3; 126/44, 45

[56] References Cited

U.S. PATENT DOCUMENTS

| | | | |
|---|---|---|---|
| 644,259 | 2/1900 | Ostergren | 62/46.3 X |
| 2,190,367 | 2/1940 | Mead | 62/48.1 X |
| 2,764,008 | 9/1956 | Gruber | 62/46.3 X |
| 3,620,661 | 11/1971 | Schlamp | 431/344 |
| 4,729,494 | 3/1988 | Peillons et al. | 222/3 |
| 4,735,568 | 4/1988 | Izumisawa et al. | 431/298 X |

FOREIGN PATENT DOCUMENTS 2-62236 2/1990 Japan .

*Primary Examiner*—Carl D. Price

*Attorney, Agent, or Firm*—Bacon & Thomas

[57] ABSTRACT

A nonwoven fabric (31) having an annular shape in the horizontal cross-sectional view is put inside of a pressure-resistant wall (11) of a gas cylinder (2) adapted to contain liquefied petroleum gas (19). An outer surface (34) of the nonwoven fabric (31) is kept in contact with an upper portion of an inner surface (20) of the pressure-resistant wall (11). A lower section (33) of the nonwoven fabric (31) is adapted to suck up the liquefied petroleum gas (19) in its liquid phase portion (25) owing to capillary action, so that the sucked up liquefied gas can be brought into contact with the upper portion of the inner surface (20) of the pressure-resistant wall (11).

8 Claims, 2 Drawing Sheets

GAS CYLINDER

BACKGROUND OF THE INVENTION

1. Field of the Invention

The present invention relates to a gas cylinder adapted to contain liquefied petroleum gas, and more particularly to a gas cylinder preferably used as a fuel cartridge for a portable burner appliance such as a portable gas stove, a portable gas lantern and the like in camping and so on.

2. Description of Prior Art

Generally, such a portable burner appliance is so constructed as to take out petroleum gas vaporized from the liquefied petroleum gas inside of a pressure-resistant wall of a fuel cartridge and burn it. In order to continue its stable burning for a long time, it is necessary to continuously supply such an amount of heat as to be consumed as latent heat of vaporization to a liquid phase portion of the liquefied gas so as to accelerate the vaporization of the liquefied gas.

A conventional fuel cartridge was adapted to receive the amount of heat to be consumed as latent heat of vaporization, through the pressure-resistant wall.

In that case, as a amount of liquefied gas remaining within the fuel cartridge is decreased by a consumption of the petroleum gas, a contact area between the liquid phase portion and the pressure-resistant wall also decreases. Therefore, with the conventional fuel cartridge, as the amount of liquefied gas remaining therewithin decreases, its vaporizing speed becomes lower and lower. As a result, the conventional fuel cartridge is accompanied with a problem that a burning in a burner appliance provided with that cartridge becomes unstable from lack of gas supply. The problem appears as a serious abuse because a proportion of a storage amount of the liquefied gas to a consuming rate thereof becomes smaller correspondingly as the fuel cartridge is more downsized.

SUMMARY OF THE INVENTION

It is an object of the present invention to enable liquefied petroleum gas to vaporize sufficiently even after an amount of the liquefied petroleum gas remaining within a gas cylinder has been decreased.

For accomplishing the above-mentioned object, a gas cylinder is constructed as follows.

For example, means for sucking up liquefied gas owing to its capillary action such as a nonwoven fabric is formed like a sheet and then put into a gas cylinder. An outer surface of the sucking up means is so placed as to face an upper inner surface of a pressure-resistant wall of the gas cylinder. Further, at least a portion of a lower section of the sucking up means is projected downwardly to a low region of a lower inner surface of the pressure-resistant wall.

The above-mentioned construction functions as follows.

When the consumption of the gas proceeds and as a result the liquefied gas remaining within the gas cylinder has decreased, the liquefied gas in the liquid phase portion is sucked up from the lower section of the sucking up means to the upper section thereof owing to the capillary action and then brought into contact with the upper inner surface of the pressure-resistant wall from an outer surface of the upper section so as to be vaporized by means of heat supplied through the upper inner surface thereof.

Therefore, although the liquefied petroleum gas remaining within the gas cylinder has been decreased, it becomes possible to accelerate the vaporization in the liquid phase portion. Consequently, it is possible to continuously and sufficiently supply the petroleum gas to the burner appliance so that the burner appliance can continue the stable burning for a long time.

Further, since the sucking up means is formed like a sheet, a storage capacity of the gas cylinder can be prevented from being narrowed by the sucking up means so that a necessary amount of gas can be contained within the gas cylinder.

BRIEF DESCRIPTION OF THE DRAWINGS

The invention will be clarified and understood more precisely by reading detailed description of preferred embodiments described below referring with annexed drawings, in which:

FIG. 1 is a perspective view of a portable gas stove;

FIG. 2 is a vertical sectional view of a fuel cartridge for the gas stove;

FIG. 3 is an enlarged view of a portion indicated by the arrow III in FIG. 2;

FIG. 4 is a view corresponding to FIG. 2; and

FIG. 5 is a view corresponding to FIG. 3.

DESCRIPTION OF THE PREFERRED EMBODIMENTS

First Embodiment

Figure 1:
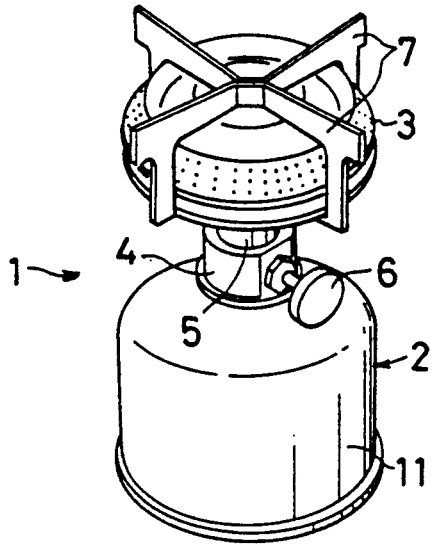
FIGS. 1 through 3 show a first embodiment of the present invention.
Figure 3:
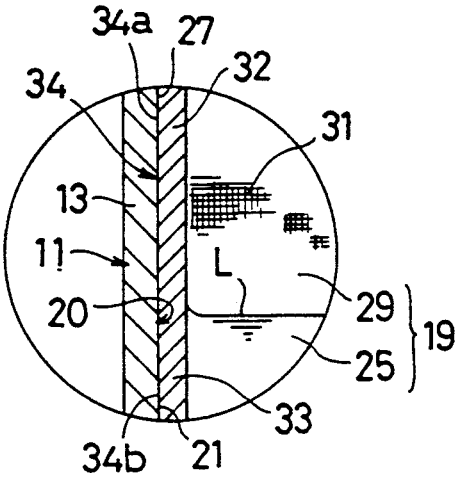
Figure 2:
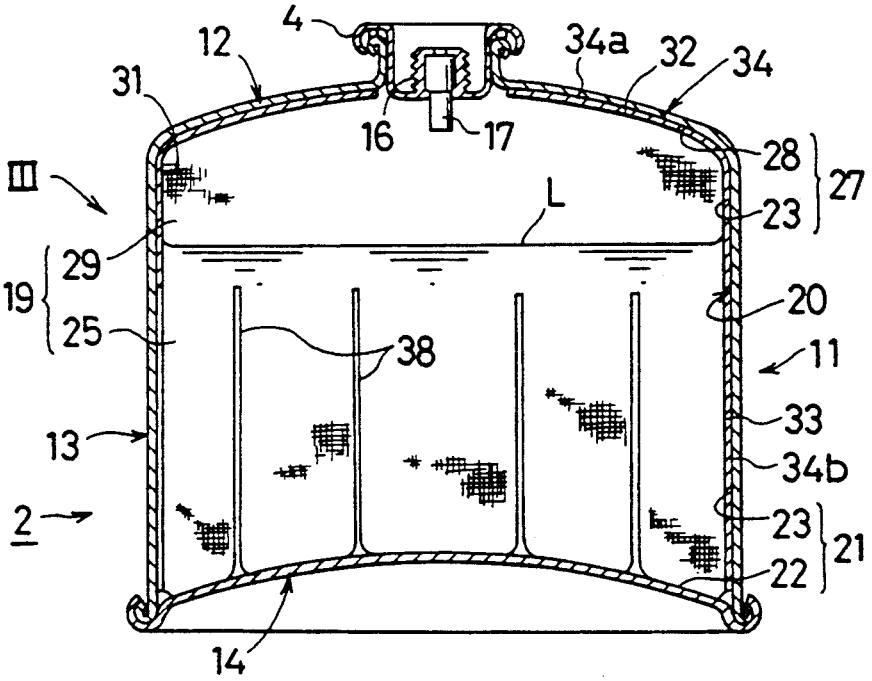

FIGS. 1 through 3 show a first embodiment of the present invention.

As shown in FIG. 1, a portable gas stove 1 comprises a fuel cartridge 2 as a small gas cylinder and a gas burner 3. An inlet nozzle 5 of the gas burner 3 is fixedly connected to an outlet nozzle 4 disposed at an upper portion of the fuel cartridge 2. Numeral 6 indicates a nob for adjusting gas flow, provided at the outlet nozzle 4. Numeral 7 indicates a support for receiving a kettle (not illustrated).

As shown in FIGS. 2 and 3, the fuel cartridge 2 has the following construction.

A pressure-resistant wall 11 comprises an upper wall 12, a trunk wall 13, the upper wall 12 being formed integrally with the trunk wall 13, and a bottom wall 14 and has such an outer dimension as being about 11 cm in diameter and about 8 cm in height. The outlet nozzle 4 is fixed to a central portion of the upper wall 12, and a bottom surface of the gas burner 3 faces the upper wall 12 directly. When the inlet nozzle 5 of the gas burner 3 is threadably secured to a connection screw 16 of the outlet nozzle 4, a valve 17 disposed inside of the connection screw 16 is opened so that it becomes possible to withdraw gas from the fuel cartridge 2.

Liquefied petroleum gas 19 composed of about 30% by weight of propane and about 70% by weight of normal butane is contained inside of the pressure-resistant wall 11. The pressure-resistant wall 11 has an inner surface 20 comprising a lower inner surface 21 and an upper inner surface 27. The lower inner surface 21 comprises an inner surface 22 of the bottom wall 14 and a lower portion of an inner surface 23 of the trunk wall 13, and a liquid phase portion 25 of the liquefied petroleum gas 19 is kept in contact with the lower inner surface 21. The upper inner surface 27 comprises an inner surface 28 of the upper wall 12 and an upper portion of the inner surface 23 of the trunk wall 13, and a gas phase portion 29 of the liquefied petroleum gas 19 is kept in contact with the upper inner surface 27.

A sheet-shaped nonwoven fabric 31 is put inside of the pressure-resistant wall 11. The nonwoven fabric 31 has its unit weight set at about 80 g/m$^2$ and comprises an upper section 32 formed like a semispherical shell and a tubular lower section 33. An outer surface 34 of the nonwoven fabric 31 is kept in contact with the inner surface 20 of the pressure-resistant wall 11.

That is, an upper outer surface 34*a* of the upper section 32 of the nonwoven fabric 31 is kept in contact with a substantially entire area of the inner surface 28 of the upper wall 12 and fixed at a plurality of points thereto by means of adhesive. Further, the lower section 33 of the nonwoven fabric 31 is projected downwardly to near the bottom wall 14. A lower outer surface 34*b* of the lower section 33 is kept in contact with a lower portion of the inner surface 23 of the trunk wall 13. The lower section 33 of the nonwoven fabric 31 is provided circumferentially with a plurality of slits 38 opening downwardly.

As shown in FIG. 2, since a contact area between the liquid phase portion 25 of the liquefied gas 19 and the pressure-resistant wall 11 is large under such a condition that much liquefied petroleum gas 19 remains within the fuel cartridge 2, much heat is supplied from the pressure-resistant wall 11 to the liquid phase portion 25 so as to accelerate the vaporization in the liquid phase portion 25.

When an amount of the liquefied petroleum gas 19 remaining within the fuel cartridge 2 decreases, the liquefied gas of the liquid phase portion 25 is sucked up to a higher position than a liquid level L of the liquid phase portion 25 from the lower section 33 of the nonwoven fabric 31 owing to the capillary action and then brought into contact with the upper inner surface 27 of the pressure-resistant wall 11 through the upper outer surface 34*a* of the upper section 32 so as to be vaporized by the heat received from the upper inner surface 27. Accordingly, it becomes possible to accelerate the vaporization in the liquid phase portion 25. Consequently, it is possible to continuously and sufficiently supply the petroleum gas to the gas burner 3 and to continue the stable burning in the gas burner 3 for a long time.

As noted above, since the nonwoven fabric 31 is kept in contact with the inner surface 28 of the upper wall 12 which receives the heat radiated from a bottom surface of the gas burner 3, much heat can be received from the pressure-resistant wall 11 to accelerate the vaporization. In addition thereto, since the nonwoven fabric 31 can be easily and closely secured to the inner surface 28 by means of adhesive, the vaporization can be further accelerated.

Incidentally, since it is enough to merely immerse a lower end of the lower section 33 of the nonwoven fabric 31 into the liquid phase portion 25, it may be quite all right even though there is a large gap between the inner surface 23 of the trunk wall 13 and the lower section 33 of the nonwoven fabric 31.

Second Embodiment

Figure 5:
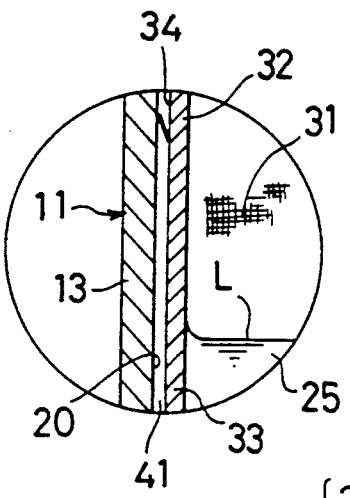
FIGS. 4 and 5 show a second embodiment thereof.
Figure 4:
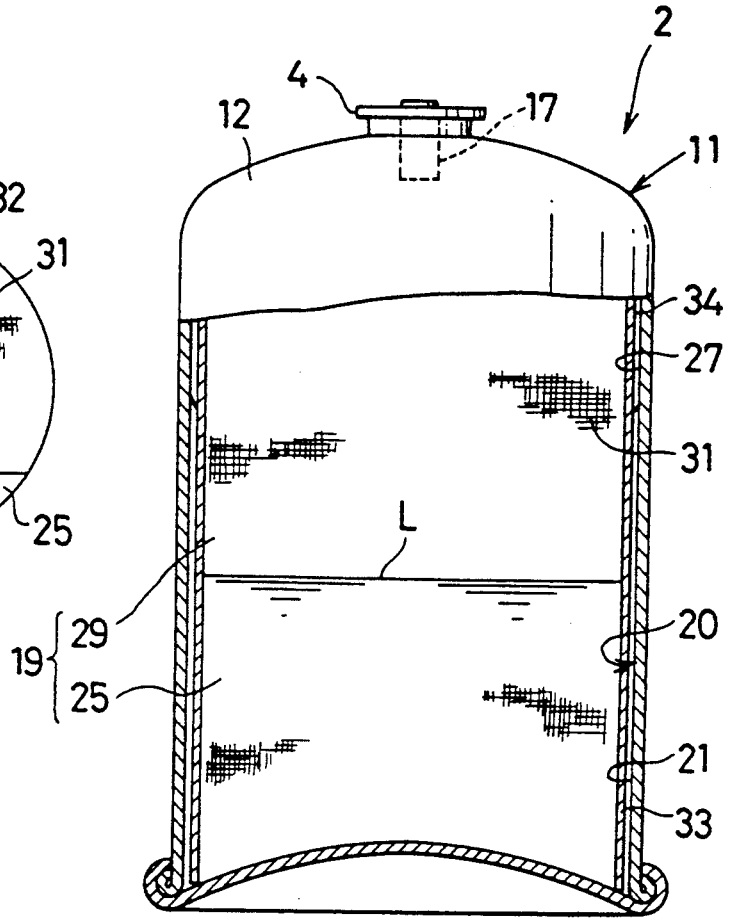

FIGS. 4 and 5 show a second embodiment of the present invention. In this second embodiment, component members having the same constructions as those in the first embodiment are designated by the same symbols.

The fuel cartridge 2 has a longer trunk in comparison with that of the first embodiment. A very small gap 41 is provided vertically between the trunk wall 13 of the pressure-resistant wall 11 and the outer surface 34 of the nonwoven fabric 31. This gap 41 is sufficient if it can suck up the liquefied gas by the capillary action, and it may be formed in an annular shape in plan view or in a plurality of segments in the peripheral direction.

Since the liquid phase portion 25 of the liquified petroleum gas 19 is adapted to be sucked up by both the capillary actions of the nonwoven fabric 31 and the very small gap 41 to a higher position than the liquid level L of the liquid phase portion 25, the sucked up liquefied gas can be brought into contact with a wider area of the inner surface 20 of the pressure-resistant wall 11.

Instead of the nonwoven fabric, the means 31 for sucking up the liquefied gas owing to the capillary action may be a woven fabric, a porous member comprising, e.g., plastic formed with a multiplicity of intercommunicated foams or a combination of hollow fibers and fabrics.

Since it is enough to merely immerse a portion of the lower section 33 of the sucking up means 31 into the liquid phase portion 25 by projecting it downwardly to a low region of the lower inner surface 21 of the pressure-resistant wall 11, the lower section 33 may be formed like belts, sashes or strings.

Further, the upper section 32 of the sucking up means 31 may be so placed as to face only a portion of the inner surface 28 of the upper wall 12 or only a portion of the upper portion of the inner surface 23 of the trunk wall 13.

A mixing ratio of the propane and the normal butane for the liquefied petroleum gas 19 may be set different from the above-mentioned one, and for the liquefied petroleum gas 19, pure propane and pure butane may be employed or other kinds of petroleum gases may be also employed.

The fuel cartridge 2 may be that which is used not only in the above-mentioned vertical position but also in lateral position.

As many different embodiments of the invention will be obvious to those skilled in the art, some of which have been disclosed or referred to therein, it is to be understood that the specific embodiments of the invention as presented herein are intended to be by way of illustration only and are not limiting on the invention, and it is to be understood that such embodiments, changes, or modifications may be made without departing from the spirit and scope of the invention as set forth in the claims appended hereto.

What is claimed is:

1. A gas cylinder comprising:

a pressure-resistant wall (11) including an upper wall portion (12), a trunk portion (13) and a bottom wall portion (14), said pressure-resistant wall having a lower inner surface (21) to be kept in contact with a liquid phase portion (25) of liquified petroleum gas (19) and an upper inner surface (27) to be kept in contact with a gas phase portion (29) of the liquified petroleum gas (19) with a portion of said upper inner surface defining an inner surface (28) of said upper wall portion (12);

means (31) for sucking up the liquified gas in said liquid phase portion (25) owing to capillary action, said means for sucking up (31) having an outer surface (34) and a lower section (33) and being formed like a sheet, said outer surface (34) being so placed as to face the upper inner surface (27) of said pressure-resistant wall (11), including the inner surface (28) of said upper wall portion (12), wherein at least a portion of the lower section (33) of said sucking up means (31) projects downwardly to a low region of the lower inner surface (21) of said pressure-resistant wall (11);

an outlet nozzle (4) disposed at said upper wall portion (12); and a gas burner unit (3) having an inlet nozzle (5) and a bottom surface, said inlet nozzle (5) being adapted to be secured to said outlet nozzle (4) with the bottom surface of said gas burner unit (3) directly facing said upper wall portion (12) of said pressure-resistant wall (11) such that said upper wall portion (12) is subjected to heat radiated from the bottom surface of said gas burner unit (3) during operation thereof which accelerates the vaporization of the liquified petroleum gas within the gas cylinder.

2. A gas cylinder as defined in claim 1, wherein said sucking up means (31) has an annular cross-sectional shape, and the lower section (33) of said sucking up means (31) projects downwardly along said lower inner surface (21) toward said bottom wall portion (14) substantially along its overall periphery.

3. A gas cylinder as defined in claim 2, wherein substantially the entire outer surface (34) of said sucking up means (31) is kept in contact with an inner surface (20) of said pressure-resistant wall (11).

4. A gas cylinder as defined in claim 2, wherein a very small gap (41) for sucking up the liquified gas owing to capillary action is formed between the outer surface (34) of said sucking up means (31) and an inner surface (20) of said pressure-resistant wall (11).

5. A gas cylinder as defined in claim 2, wherein said sucking up means (31) comprises a nonwoven fabric.

6. A gas cylinder as defined in claim 5, wherein a plurality of slits (38) opening downwardly are formed in the lower section (33) of said sucking up means (31) in the circumferential direction.

7. A gas cylinder as defined in claim 1, wherein at least a portion of the outer surface (34) of said sucking up means (31) is secured to the inner surface (28) of said upper wall (12) by means of adhesive.

8. A gas cylinder as defined in claim 7, wherein said liquified petroleum gas (19) comprises about 30% by weight of propane and about 70% by weight of normal butane.

* * * * *